United States Patent [19]

Misra

[11] 4,418,097

[45] Nov. 29, 1983

[54] COATING FOR GRAPHITE ELECTRODES

[75] Inventor: Mohan S. Misra, Lakewood, Colo.

[73] Assignee: Martin Marietta Corporation, Bethesda, Md.

[21] Appl. No.: 329,896

[22] Filed: Dec. 11, 1981

[51] Int. Cl.[3] ..... B05D 5/12

[52] U.S. Cl. ..... 427/113; 427/202; 427/203; 427/226; 427/397.7; 427/419.7

[58] Field of Search ..... 427/113, 387, 397.7, 427/226, 180, 372.2, 419.7, 202, 203; 428/408, 367, 416; 204/290 R

[56] References Cited

U.S. PATENT DOCUMENTS

| | | | |
|---|---|---|---|
| 3,116,157 | 12/1963 | Burbach | 106/69 |
| 3,120,453 | 2/1964 | Fitzer et al. | 117/217 |
| 3,553,010 | 1/1971 | Rubisch | 117/217 |
| 3,720,543 | 3/1973 | Bockstie, Jr. | 117/218 |
| 3,814,699 | 6/1974 | Baldieri et al. | 252/397 |
| 3,852,107 | 12/1974 | Lorkin et al. | 427/113 |
| 4,251,277 | 2/1981 | Martin | 106/38.22 |
| 4,292,345 | 9/1981 | Kolesnik et al. | 427/113 |

*Primary Examiner*—Norman Morganstern
*Assistant Examiner*—Richard Bueker
*Attorney, Agent, or Firm*—Patrick M. Hogan; Gay Chin; Phillip L. DeArment

[57] ABSTRACT

A process for reducing high temperature oxidation of graphite electrodes for steel making by coating the electrodes with a siloxane fluid, such as dimethylpolysiloxane. Silicon carbide particles can be suspended in the siloxane fluid to improve coating characteristics.

3 Claims, No Drawings

COATING FOR GRAPHITE ELECTRODES

BACKGROUND OF THE INVENTION

1. Field of the Invention

This invention relates to electrode coating and particularly to a new and improved coating for graphite electrodes which reduces high temperature oxidation of the electrodes.

A satisfactory oxidation resistant coating for graphite electrodes should meet the following criteria: oxidation resistance; adherence; low volatility; low permeability and porosity; thermal compatibility; low diffusion rate of oxygen and carbon; resistance to spalling and erosion; chemical compatibility with furnance environment; ease of repair; and low cost.

2. Description of the Prior Art

One primary method of manufacturing steel involves melting the components of the steel using electric current applied by large graphite electrodes. The residual porosity of graphite electrodes makes them susceptible to oxidation at high temperatures. Because of such oxidation, the electrodes become progressively unusable and must be replaced. Such replacement is undesireable not only because of the cost of the replacement electrodes but also because of reduced production capacity during resultant "down time".

Previous methods to reduce high temperature oxidation of graphite electrodes have involved plasma spraying of the electrodes with materials such as titanium and zirconium, prior to heating the electrodes to very high temperatures. Such methods, however, are relatively difficult and expensive.

In view of the above mentioned problems, therefore, it is an object of the present invention to provide a simple and economical process for protecting graphite electrodes from oxidation.

SUMMARY OF THE INVENTION

The present invention comprises a process for reducing high temperature oxidation of graphite electrodes by coating the electrodes with a siloxane fluid. In a preferred form of the process, the siloxane is dimethylpolysiloxane. In addition, silicon carbide particles can be suspended in the siloxane fluid to improve oxidation resistance and bonding.

DETAILED DESCRIPTION OF THE INVENTION

The present invention comprises a process for coating graphite electrodes in order to reduce high temperature oxidation of the electrodes. The coating comprises a siloxane fluid which can be applied to the graphite electrode when the electrode is either at ambient temperature or after it has been heated. One example of a suitable siloxane fluid is dimethylpolysiloxane, commercially available from Dow Corning as silicone fluid DC-200. Other polysiloxanes are commercially available and are considered suitable for use in this invention. In the presence of heat, such as when the electrodes are heated, the siloxane fluid breaks down into silicon oxide (SiO), and silicon carbide (SiC). The SiO leaves the electrode in the form of gas. When this gas mixes with the surrounding atmosphere, some silicon dioxide ($SiO_2$), in the form of a crystal or an amorphous powder, is formed. This powder, which is a refractory oxide, collects on the surface of the electrode, forming an outer coating. The SiC penetrates the electrode surface, forming a subsurface or inner coating bonded to the graphite. It is theorized that this interface comprises SiC, and possibly a non-stoichiometric alloy of silicon and carbon in combination with SiC. This interface or layer is highly adherent to the graphite, and forms a suitable base for the $SiO_2$ surface layer.

The $SiO_2$ which forms the outer coating is a soft, pliable and compact powder. The $SiO_2$ coating not only prevents oxygen diffusion into the graphite matrix, thus retarding oxidation, but also effectively withstands thermal shock and stresses generated by thermal expansion while the electrode is being heated.

The subsurface SiC provides long term oxidation protection, even after the $SiO_2$ surface coating is gone due to spalling, air currents, or other causes.

The coating of the present invention is also described as "self healing". That is, vapor transport will cause originally uncoated areas of electrodes to be covered with the $SiO_2$ coating as it forms.

The coating becomes even more effective when silicon carbide (SiC) particles are suspended in the siloxane fluid. The SiC-siloxane fluid is then applied to the electrodes. The suspension may consist of 0.5 to 40.0 weight percent SiC with the remainder being siloxane fluid, the preferred range being from 0.5 to 35 weight percent SiC.

It has been found that the viscosity of the siloxane fluid is not critical, and may be chosen to suit the application method utilized. Suitable viscosities range from easily flowable materials (waterlike), which may be sprayed, to heavy, thick materials (molasses-like) which require brushes. Preferred viscosities range from about 100 to about 500 centistokes. Of course, the presence of SiC particles will also effect viscosity.

The SiC particles, if added, may be commercially available SiC, with particle sizes from about 100- to 700-mesh, preferably from about 200-mesh to 400-mesh size, and most preferably from about 240-mesh to 320-mesh. It is desired to utilize small particle sizes to assure even distribution in the siloxane fluid when blending the SiC and fluid, and the mixture should be decanted after mixture to obtain the most uniform blend.

The coating may be applied to the electrode by a variety of methods, either before installation in the furnance at a remote location, or in-situ between melts. Suitable coating methods include vacuum impregnation, dipping, spray coating, and brushing. The coating may be applied to the electrode at ambient temperatures. At temperatures higher than about 1000° F., $SiO_2$ fuming may become excessive. Preferably, the surface temperature of the graphite is less than 800° F.

The preparation and use of the coating may be more readily understood from the following examples. In these examples, oxidation resistance was measured by weight loss. The less the weight loss, the better the oxidation resistance. For all examples, for the same electrode heating time and temperature, uncoated control specimens of electrode had weight losses exceeding 32 percent.

EXAMPLE 1

Dimethylpolysiloxane, having 100 centistokes viscosity, was sprayed on a graphite electrode while the electrode was at ambient temperature. The electrode was then heated to 1400° F. for eight hours. Weight loss was 6.8%.

EXAMPLE 2

Silicon carbide particles, 240- and 320-mesh sizes were suspended in dimethylpolysiloxane fluid of 100 centistoke viscosity, SiC being $33\frac{1}{3}$ weight percent with the remainder dimethylpolysiloxane. The fluid was then sprayed on a graphite electrode with the electrode at ambient temperature. The electrode was heated to 1400° F. for eight hours. Weight loss was 3.2%.

EXAMPLE 3

Solutions of 30 grams of 320-mesh SiC in 300 milliliters of dimethylpolysiloxane fluid (100 and 500 centistoke viscosities) were thoroughly stirred, and let stand for 48 hours. The coarse SiC particles settled out, and finer particles remained suspended. After decanting, the coating mixtures were brushed on graphite electrodes and oxidized at 1800° F. for 4 hours. Weight losses of 19.7% (100 centistoke viscosity), 16.3% and 17.4% (500 centistoke viscosity) were observed.

From the above examples, it can be seen that oxidation resistance of graphite electrodes can be improved by coating the electrodes with a siloxane fluid, such as dimethylpolysiloxane. Additives such as SiC to the siloxane fluid prior to its application to the electrodes further improves oxidation resistance.

It is to be understood that this invention is not limited to the particular forms disclosed and it is intended to cover all modifications coming within the true spirit and scope of this invention as claimed.

What is claimed is:

1. A process for reducing high temperature oxidation of a graphite electrode by forming on said electrode an outer coating of $SiO_2$ powder and a subsurface coating of SiC bonded to the electrode surface, said process consisting of the steps of:

(a) suspending SiC particles in a dimethylpolysiloxane fluid;

(b) coating said electrode with the SiC-dimethylpolysiloxane fluid; and (c) heating said electrode to thereby facilitate the formation of said outer coating of $SiO_2$ powder and said subsurface coating of SiC.

2. The process of claim 1 wherein said suspension consists of 0.5 to 40.0 weight percent SiC with the remainder dimethylpolysiloxane.

3. The process of claim 2, wherein said SiC particles are from about 240-mesh to about 320-mesh in size.

* * * * *